United States Patent [19]

Roosa et al.

[11] 4,388,736

[45] Jun. 21, 1983

[54] TANK FLUSHING MEANS

[76] Inventors: Peter V. Roosa, 253 Fairview Ave., West Hartford, Conn. 06514; Vernon D. Roosa, 184 Wood Pond Rd., West Hartford, Conn. 06107

[21] Appl. No.: 270,368

[22] Filed: Jun. 4, 1981

[51] Int. Cl.[3] ..... E03D 1/14

[52] U.S. Cl. ..... 4/324; 4/395; 4/393; 4/394; 4/405

[58] Field of Search ..... 4/324–326, 4/331, 353–359, 378–379, 391–396, 405, 413–415, 327, 411, 249; D23/33

[56] References Cited

U.S. PATENT DOCUMENTS

| | | | |
|---|---|---|---|
| 2,908,914 | 10/1959 | Lasecki | 4/324 |
| 3,992,728 | 10/1975 | Jay | 4/405 |
| 4,183,107 | 1/1980 | Hare et al. | 4/324 |
| 4,184,215 | 1/1980 | Birdsall | 4/393 |

FOREIGN PATENT DOCUMENTS

| | | | |
|---|---|---|---|
| 1080902 | 7/1980 | Canada | 4/324 |

*Primary Examiner*—Stephen Marcus
*Assistant Examiner*—Kenneth S. Putnam
*Attorney, Agent, or Firm*—Holland, Armstrong, Wilkie & Previto

[57] ABSTRACT

An improvement is described for a tank type toilet flushing system. A positive coupling is provided between the flushing handle and the tank emptying flushing valve including a rigid flush control rod. This permits the flush to be terminated at will and before the flush tank is completely emptied. The flush control rod has a bent, length adjusting section, and a bent section for removably mounting a float.

2 Claims, 4 Drawing Figures

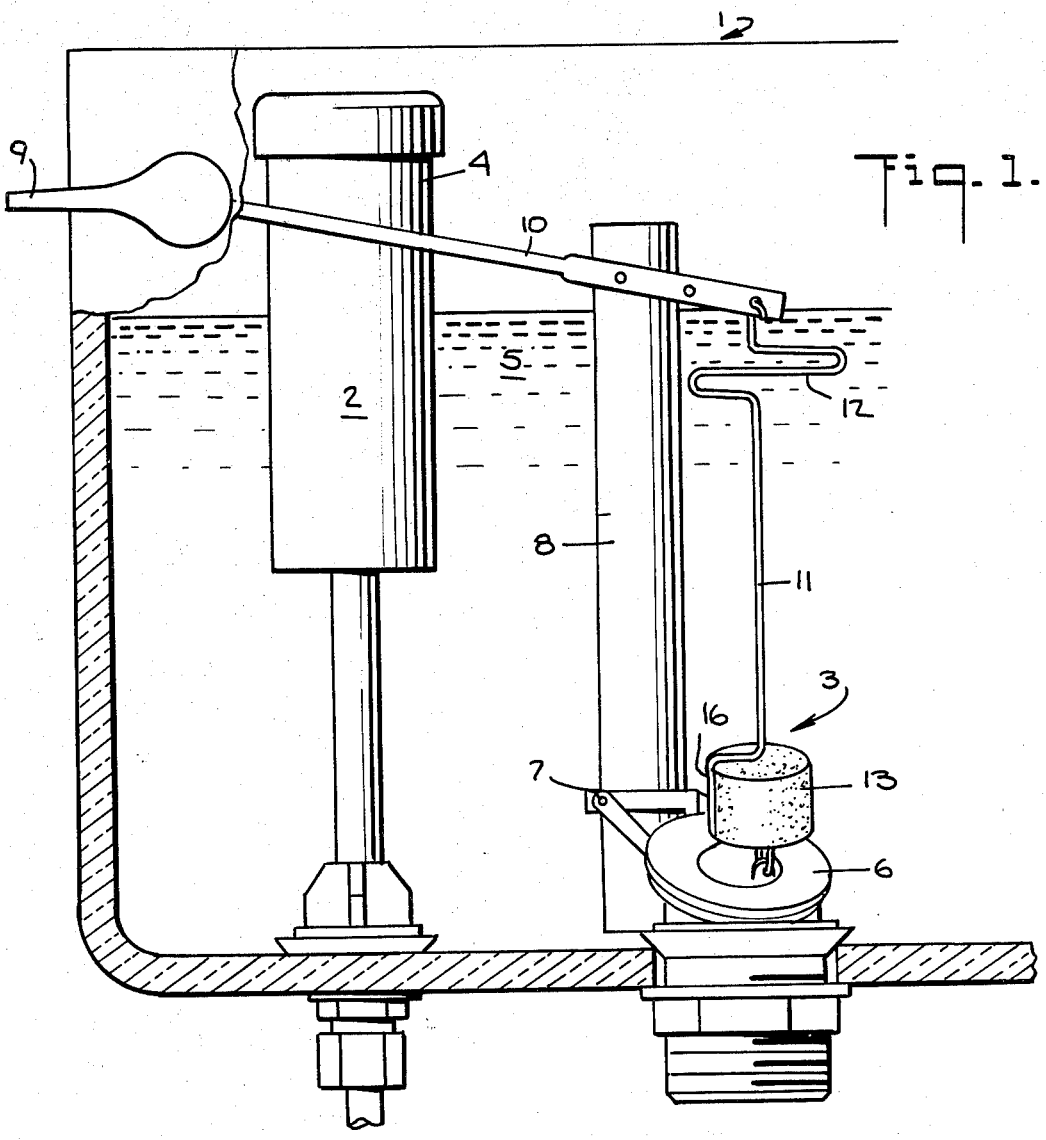
Fig. 1.
Fig. 3.
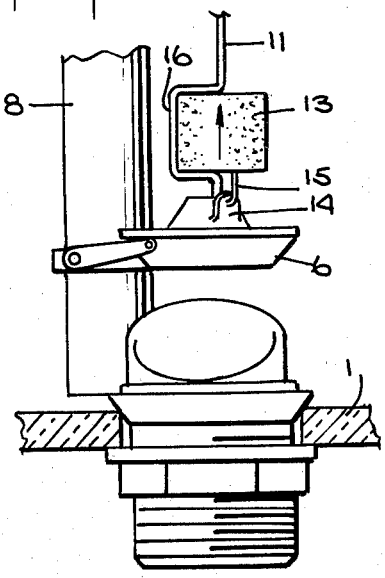
Fig. 4.
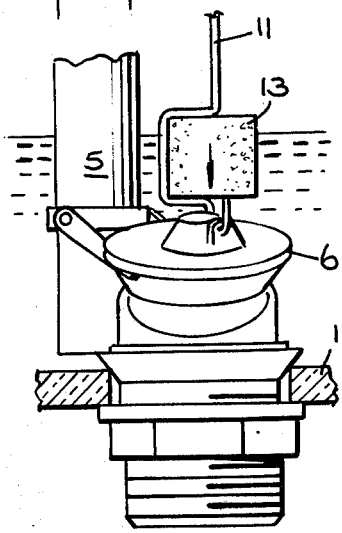
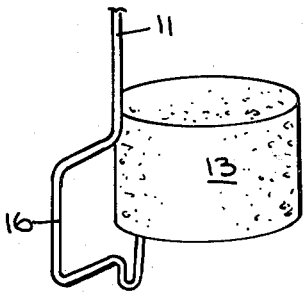
Fig. 2.

TANK FLUSHING MEANS

The present invention relates to an improved flushing apparatus for a flush tank used for toilet bowls and the like. In particular it provides an improved means for reducing the amount of flushing water utilized by permitting the flushing action to be terminated under the control of the operator.

The improved flushing apparatus of the present invention is for use in the tank type toilet flushing means now widely used. Such flushing devices utilize a storage tank and handle control means for initiating the flushing action. This is normally done by operating a flushing valve so that the system goes through one complete flushing cycle where the flushing tank is completely emptied during the cycle and is then automatically refilled.

The present invention provides means for terminating the outflow of the water from the flushing tank under the control of the operator to permit an effective flush utilizing only a portion of the tank water.

Accordingly, an object of the present invention is to provide an improved apparatus for a controlled toilet flush wherin the operator may adjustably control the amount of water utilized.

Another object of the present invention is to provide an improved apparatus for a controlled toilet flush wherein the operator may adjustably control the amount of water utilized.

Another object of the present invention is to provide an improved flushing apparatus for a toilet or the like.

Another object of the present invention is provide an improved tank type toilet apparatus.

Other and further objects of the present invention will be obvious upon an understanding of the illustrative embodiments about to be described or will be indicated in the appended claims, and various advantages not referred to herein will occur to one skilled in the art upon employment of the invention in practice.

ILLUSTRATION OF THE PREFERRED EMBODIMENT

FIG. 1 is a front elevational view of a preferred embodiment of the flushing apparatus in accordance with the present invention.

FIG. 2 is an enlarged fragmentary perspective view of the flush control rod in accordance with the present invention.

FIG. 3 and 4 are enlarged elevational views of the flushing apparatus in accordance with the invention in its open and closed position respectively.

DESCRIPTION OF THE PREFERRED EMBODIMENTS

The apparatus of the present invention is for use with a conventional tank type toilet flushing system including a tank 1 with a water inlet valve 2 and a handle controlled flushing valve. In such systems, the tank is filled through the inlet valve 2 which is coupled to a source of water under pressure. The water inlet to the tank 1 includes the inlet valve 2 controlled by a float 4. Such an inlet valve is illustrated, for example, in U.S. Pat. No. 3,982,566 dated Sept. 28, 1976. The inlet valve 2 is controlled by the level of water 5 in the flush tank 1. Whenever the water falls below a predetermined level, as during a flushing cycle, the inlet valve 2 opens to admit tank refilling water. When the water 5 rises within the tank 1 the float 4 is lifted by the water level to shut off the incoming water supply at a predetermined water level. The inlet valve forms no portion of the present invention.

The flushing operation is performed by the flush valve 3 which is opened to initiate the flushing action and which automatically recloses at the end of the flushing cycle. In the present flush tanks, the flushing valve is opened by a flushing handle and the tank is emptied at which point the flushing valve drops closed and thereafter remains closed for the above described refilling action.

The improved flushing apparatus of the present invention, which will now be described, includes means for terminating the flow of the water 5 from the tank 1 at any time after the flush has been started and at the control of the operator. This permits the flushing action to be stopped while the tank remains partially full of water thereby conserving water.

As illustrated in FIG. 1, the flushing apparatus includes a flapper type valve 6 pivotally mounted at 7 on the tank 1 or the overflow tube 8 or otherwise so that it may be moved from the close position as illustrated in FIG. 4 to an open position as illustrated in FIG. 3 under the control of a flush handle 9. The pivotally mounted flush handle 9 has an interconnected flush lever 10. The lever 10 is rotated in a counter clockwise direction (FIG. 1) so that its free or right hand end is raised within the tank 1 lifting the interconnected flush control rod 11 and the flapper valve 6 connected to the lower end of the flush control rod 11. When the flush valve 3 is thus opened, it tends to remain open due to the inherent bouyancy of both the flapper valve 6 and a float member provided on the flush control rod 11. Under normal conditions and in the absense of further movement of the flush handle 9, the flush valve 6 will remain open until the flush water 5 in the tank 1 has drained out of the tank 1 at which point the flapper valve 6 and the interconnected flush rod 11 drop down to the closed position. The rising water admitted through the inlet valve 2 flows over and around the flapper valve 6 so that made the water pressure keeps the flush valve 3 closed. The flow control rod 11 is made of relatively stiff material such as a copper or aluminum rod material permitting force to be transmitted by it from the control lever 10 to the flapper valve 6. In order to terminate the flow of water from the tank at any point during the flushing action, it is only necessary to turn the flush handle 9 in a clockwise direction thereby forcing the control lever 10 and the interconnected flush rod 11 downwardly and back to the closed position.

The flush control rod 11 is preferably made of a corrosion resistant material of suitable stiffness for the above described closing action. An aluminum rod with a diameter of about 3/32 of an inch or a generally similar brass rod is suitable for this purpose.

In order to make the lengh of the control rod 11 easily adjustable and to permit it to be installed in a flushing tank in place of chains or other connecting links, an S-shaped bend 12 is provided in the rod. Such a bend does not interfere with the transmission of sufficient force during the above described valve closing operation but at the same time permits a rod adjustment during installation.

In order to counter balance the weight of the flush lever 10 and the flush control rod 11, a Styrofoam or other float 12 is preferably provided on the control rod 11. It is conveniently mounted by being frictionally inserted within a C-shaped section 16 of the control rod 11 as illustrated in FIGS. 2 through 4. The lower end of the rod 11 is conveniently attached to a provided at the bottom of the flush control rod 11. The hook 15 may be inserted into the flapper valve eye 14 before the top of the flush control rod 13 is pressed into position on the control rod 11 so that it is firmly mounted thereon and so that it closes the top of the flapper valve coupling hook 15.

It will be seen that a means has been provided to improve the efficiency of a tank type flushing system and more particularly that a relatively simple, easily mounted, and effective control has been provided for adjustably reducing the amount of water utilized for toilet flushing.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

What is claimed is:

1. In a flush tank having a movably mounted flush valve in the bottom which is normally moved to an open position by a handle operated means and which is kept open by the liquid in the tank and which also closes as a result of the flow of the liquid from the tank, the improvement comprising a relatively rigid coupling member operatively connecting the handle to the flush valve whereby said flush valve may also be closed by the said handle at any time during the flushing action and while the tank still contains a substantial volume of liquid, said coupling member comprising a relatively rigid rod with means for connecting opposite ends to said lever and to said flush valve and being capable of transmitting both upward opening and downward closing force to said flush valve, and said rod comprising a bendable metallic rod having a bent length adjusting and a second bent section, and a float member mounted in said second bent section.

2. The flush tank as claimed in claim 1 in which said float member comprises a removably mounted member.

* * * * *